US012612209B2

(12) United States Patent
Gibson

(10) Patent No.: US 12,612,209 B2
(45) Date of Patent: Apr. 28, 2026

(54) BAG HOLDER

(71) Applicant: James Edward Gibson, Springfield, MO (US)

(72) Inventor: James Edward Gibson, Springfield, MO (US)

( * ) Notice: Subject to any disclaimer, the term of this patent is extended or adjusted under 35 U.S.C. 154(b) by 0 days.

(21) Appl. No.: 18/671,399

(22) Filed: May 22, 2024

(65) Prior Publication Data

US 2024/0391628 A1 Nov. 28, 2024

Related U.S. Application Data

(60) Provisional application No. 63/606,717, filed on Dec. 6, 2023, provisional application No. 63/504,108, filed on May 24, 2023.

(51) Int. Cl.
*B65B 67/12* (2006.01)

(52) U.S. Cl.
CPC ..... *B65B 67/1233* (2013.01)

(58) Field of Classification Search
CPC .. B65B 67/1233; B65B 67/1238; B65B 67/12
USPC ..... 248/99, 100, 101; 294/214, 1.4
See application file for complete search history.

(56) References Cited

U.S. PATENT DOCUMENTS 289,181 A * 11/1883 Valentine ..... B65B 67/12 248/99
1,265,996 A * 5/1918 Cerny ..... B65B 67/12 141/390
3,052,214 A * 9/1962 Johnson ..... E01H 1/1206 294/1.4
3,716,263 A * 2/1973 Gatti ..... A47L 13/52 294/1.4
3,754,785 A * 8/1973 Anderson ..... A47L 13/52 294/1.4
3,977,715 A * 8/1976 Casci ..... E01H 1/1206 D30/162
4,023,842 A * 5/1977 Harvey ..... B65B 67/1238 294/1.3
4,047,746 A * 9/1977 Radowski ..... E01H 1/1206 294/1.4
4,196,928 A * 4/1980 Spangler ..... E01H 1/12 294/1.4
4,341,410 A * 7/1982 Summach ..... E01H 1/1206 294/1.3
4,705,310 A * 11/1987 Scripter ..... E01H 1/1206 15/257.7

(Continued)

*Primary Examiner* — Kimberly T Wood
(74) *Attorney, Agent, or Firm* — Stinson LLP

(57) ABSTRACT

A bag holder is configured for holding a bag to be filled with lawn debris. The bag holder comprises a bag support frame and a handle attached to the bag support frame. The bag support frame is configured to mount and support the bag. The bag support frame forms a bag opening sized and shaped to receive an open end portion of a bag. The bag holder may be configured in a closed configuration wherein the bag holder is configured to be inserted into a mouth of the bag, and an open configuration wherein the bag holder is configured to permit an open end portion of the bag to be folded over the bag support frame, handle, and back on itself to mount or couple the bag to the bag holder. The handle is sized and shaped so a user may grasp the handle and a portion of the bag.

13 Claims, 16 Drawing Sheets

(56) References Cited

U.S. PATENT DOCUMENTS

| | | | | | |
|---|---|---|---|---|---|
| 4,875,729 | A * | 10/1989 | Peck | E01H 1/1206 | 294/1.3 |
| 4,962,956 | A * | 10/1990 | Scripter | E01H 1/1206 | 15/257.4 |
| 5,050,920 | A * | 9/1991 | Potticary | B65B 67/12 | 15/257.1 |
| 5,593,117 | A | 1/1997 | Alexander, III | | |
| 5,655,739 | A | 8/1997 | Teh-Wah Goo | | |
| 6,530,690 | B2 * | 3/2003 | Smith | G07D 9/00 | 383/33 |
| 6,648,387 | B2 * | 11/2003 | Kaplan | E01H 1/1206 | 294/1.5 |
| 7,374,135 | B2 | 5/2008 | Romero | | |
| 9,718,571 | B1 | 8/2017 | Busboom | | |
| 2006/0152023 | A1 * | 7/2006 | Owens, III | B65F 1/1415 | 294/214 |
| 2013/0062895 | A1 * | 3/2013 | Groth | A01K 29/00 | 294/1.3 |

* cited by examiner

BAG HOLDER

CROSS-REFERENCE TO RELATED APPLICATIONS

This application claims the benefit of U.S. Provisional Patent Application Ser. No. 63/504,108 filed on May 24, 2023 and U.S. Provisional Patent Application Ser. No. 63/606,717 filed on Dec. 6, 2023, the entire contents of which are hereby incorporated by reference.

FIELD

The present disclosure generally relates to a bag holder, and more specifically, to a bag holder for holding a bag to be filled with leaves.

SUMMARY

Aspects of the present disclosure provide an improved bag holder for holding open a bag while sweeping or raking debris from the ground into the bag.

In one aspect, a bag holder for holding a bag comprises a body having a bag support frame and a handle attached to the bag support frame. The bag support frame has a bag opening sized and shaped to receive an open end portion of the bag. The bag support frame is sized and shaped relative to the open end portion of the bag to permit the open end portion of the bag to be folded over the bag support frame to mount the bag on the bag holder and to hold open a mouth of the bag.

In another aspect, a bag holder for holding a bag comprises a bag support frame having a deployed configuration and a collapsed configuration. The bag support frame in the deployed configuration forms a bag opening sized and shaped to receive an open end portion of the bag. The bag support frame in the deployed configuration is sized and shaped relative to the open end portion of the bag to permit the open end portion of the bag to be folded over the bag support frame to mount the bag on the bag holder and to hold open a mouth of the bag. A handle is attached to the bag support frame.

In another aspect, a method of collecting debris comprises attaching a bag to a bag holder by folding an open end portion of the bag over a bag support frame of the bag holder. The bag and a handle of the bag holder are simultaneously grasped in one hand. The bag and the bag holder are moved with said one hand to collect the debris.

In another aspect, a bag holder for holding a bag comprises a bag support frame having a bag opening sized and shaped to receive an open end portion of the bag. The bag support frame is sized and shaped relative to the open end portion of the bag to permit the open end portion of the bag to be folded over the bag support frame to mount the bag on the bag holder and to hold open a mouth of the bag. A handle is attached to the bag support frame.

In another aspect, a bag holder for holding a bag comprises a bag support frame having a bag opening sized and shaped to receive an open end portion of the bag. The bag support frame is sized and shaped relative to the open end portion of the bag to permit the open end portion of the bag to be folded over the bag support frame to mount the bag on the bag holder and to hold open a mouth of the bag. A handle is attached to the bag support frame. The handle includes a bag retainer configured to secure the bag to the bag support frame.

In another aspect, a bag holder for holding open a bag while sweeping or raking debris from the ground into the bag comprises a footing comprising a left portion and a right portion. The footing is insertable into the mouth of the bag whereby a lower portion of the mouth is stretched across the footing from the left portion to the right portion establishing a wide flat edge along the lower portion of the mouth of the bag for ground contact. A frame extends upward from the footing to an upper end portion. The frame defines a framed opening. A handle is at the upper end portion of the frame. The handle is configured to be gripped with one hand for one-handed manipulation of the bag holder and bag. The frame and the handle are sized and arranged so that when the footing is inserted into the mouth of the bag to establish the wide flat edge along the lower end portion of the mouth of the bag. One hand gripping the handle can simultaneously grasp an upper portion of the mouth of the bag to hold the mouth open adjacent the framed opening such that debris can be raked through the framed opening into the bag.

In another aspect, a bag holder for holding open a bag while sweeping or raking debris from the ground into the bag comprises a frame comprising an upper end portion and a lower end portion. The frame defines a framed opening. A handle is at the upper end portion of the frame. The handle is configured to be gripped with one hand for one-handed manipulation of the bag holder and bag. A footing extends downward from the lower end portion of the frame. The footing comprises a left foot and a right foot. The left and right feet are configured to be bent between a closed frame configuration wherein the framed opening is generally closed, and an open frame configuration wherein the framed opening is open. The footing in the closed frame configuration is configured to permit an open end portion of the bag to be folded over the frame to mount the bag on the bag holder and to hold open a mouth of the bag. The footing in the open frame configuration is insertable into the mouth of the bag whereby a lower portion of the mouth is stretched across the footing from the left foot to the right foot establishing a wide flat edge along the lower portion of the mouth of the bag for ground contact.

BACKGROUND

Leaves and other lawn debris, such as grass clippings, sticks, etc., are frequently removed from a yard and placed in bags, such as plastic trash bags, to be thrown away.

BRIEF DESCRIPTION OF THE DRAWINGS

Corresponding reference characters indicate corresponding parts throughout the drawings.

DETAILED DESCRIPTION

Figure 1:
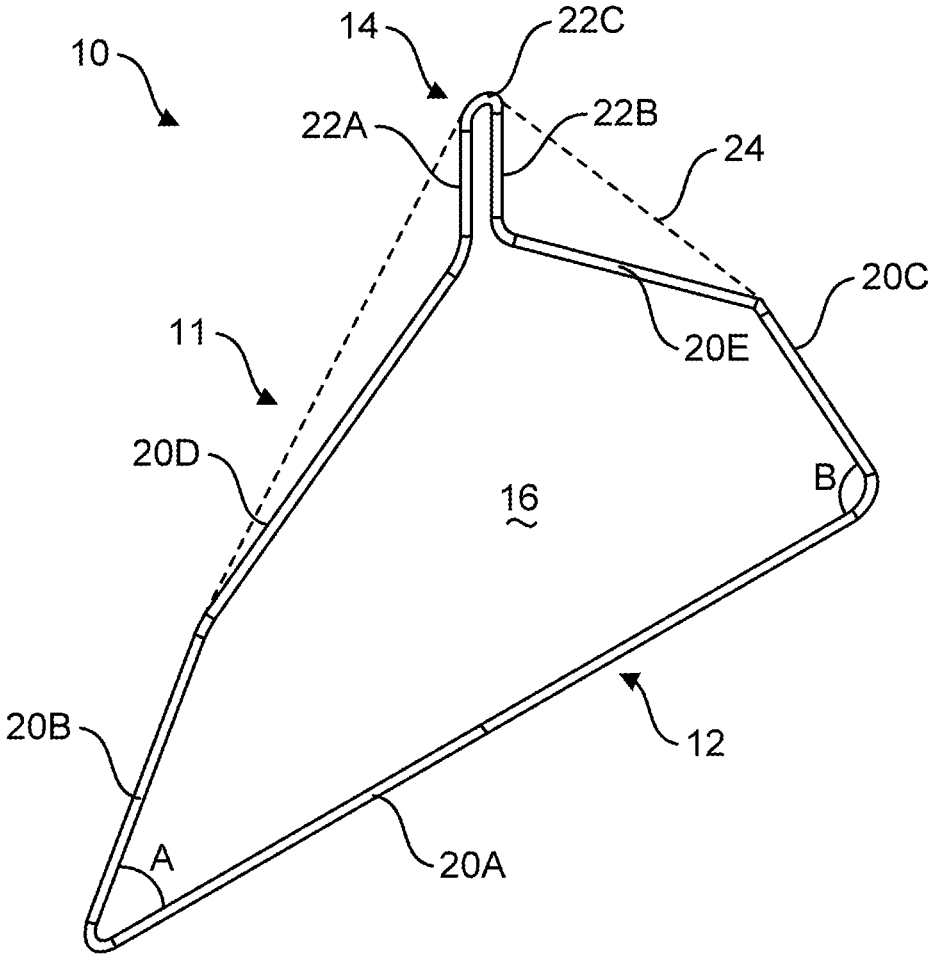
FIG. 1 is a perspective of a bag holder.
Figure 2:
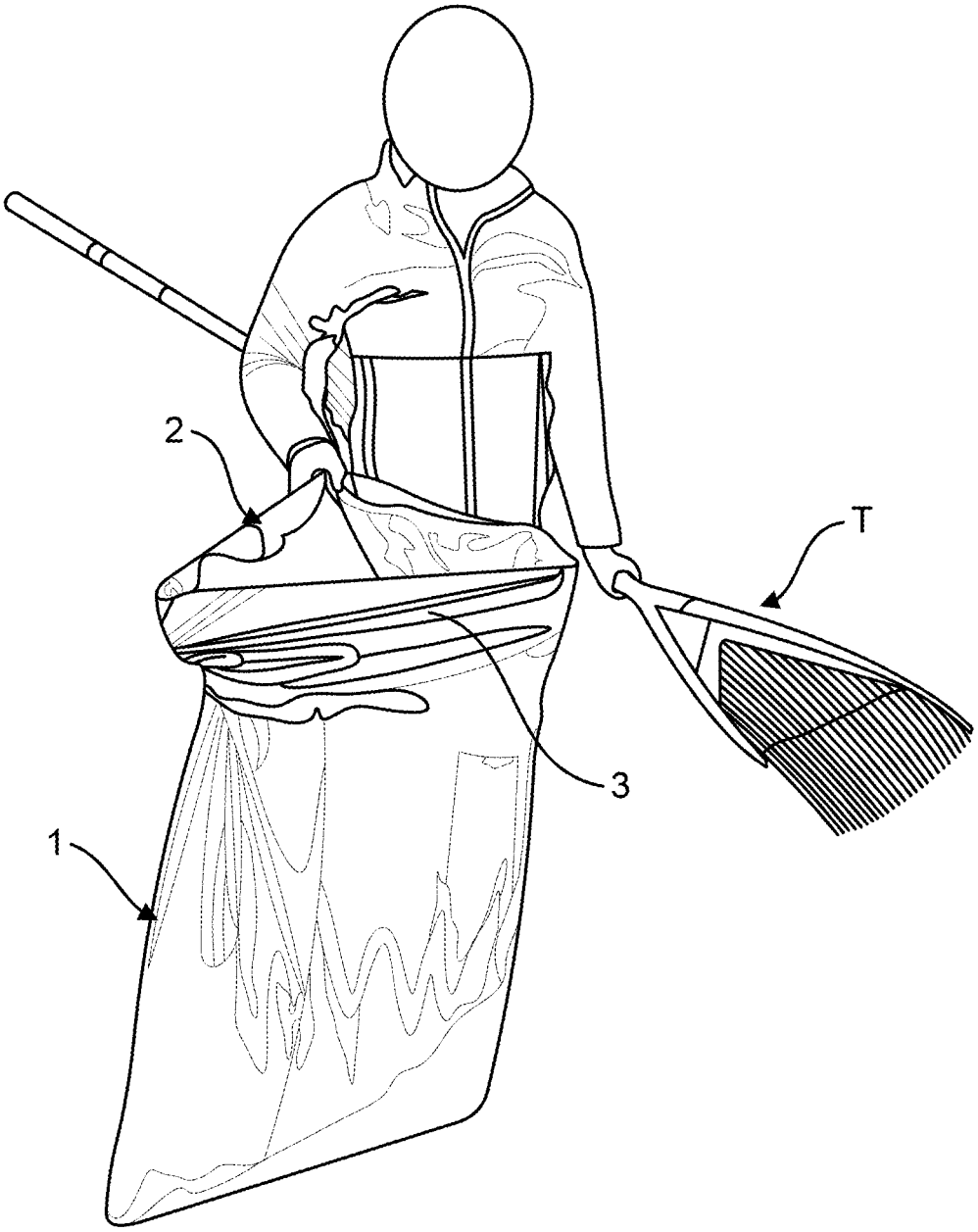
FIG. 2 is an illustration of a bag mounted on the bag holder.

Referring to FIGS. 1-2, a bag holder according to one embodiment of the present disclosure is generally indicated at reference numeral 10. The bag holder 10 is used to support a bag 1, such as a plastic garbage bag, and hold a mouth 2 of the bag open to allow a user to move items into the bag. For example, the user can rake lawn debris, such as leaves, grass clippings, sticks, etc., into a bag 1 supported by the bag holder 10. It is understood the bag holder 10 may be used in other contexts without departing from the scope of the present disclosure.

Figure 3:
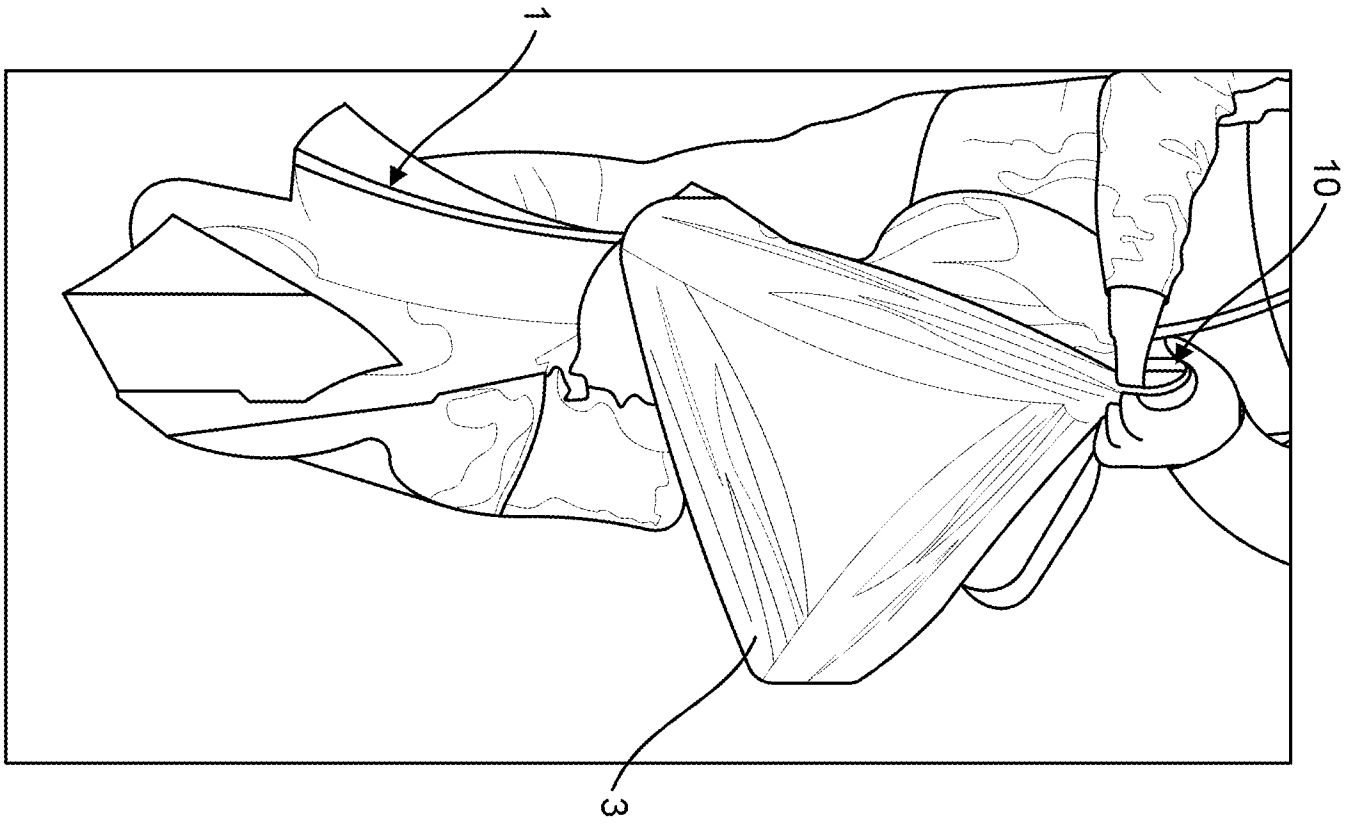
FIG. 3 is an illustration of the bag being mounted to the bag holder.

The bag holder 10 includes a bag support frame 12 and a handle 14 attached to the bag support frame. The bag support frame 12 is configured to mount and support the bag 1. The bag support frame 12 has (e.g., forms) a bag opening 16 sized and shaped to receive the open end portion 3 of the bag 1. The bag support frame 12 is sized and shaped relative to the open end portion 3 of the bag 1 to permit the open end portion of the bag to be folded over or wrapped around the bag support frame to mount the bag on the bag holder 10 and to hold open the mouth 2 of the bag. The open end portion 3 of the bag 1 is inserted through the bag opening 16 and then folded around the bag support frame 12 (and the handle 14) generally back on itself, as shown in FIGS. 2 and 3, to mount or couple the bag to the bag holder 10. The bag support frame 12 is free of any sharp corners, protrusions, and other elements which could potentially rip the bag 1 when the bag is mounted on the bag support frame. The bag support frame 12 and handle 14 have smooth exterior surfaces (e.g., only smooth exterior surfaces) to facilitate the folding of the bag 1 over the bag holder 10 without tearing or ripping the bag. The bag support frame 12 substantially bounds the perimeter of the bag opening 16. In the illustrated embodiment, the bag support frame 12 and the handle 14 bound the entire perimeter of the bag opening 16. In other embodiments, the bag support frame 12 may bound the entire perimeter of the bag opening 16.

In the illustrated embodiment, the bag support frame 12 has a generally pyramid or trapezoidal shape, although other shapes are within the scope of the present disclosure. The bag support frame 12 comprises a plurality of elongate segments 20A-E (broadly, one or more segments). The elongate segments 20 are each linear, with the ends of the elongate segments being connected by curved corners having a radius, so they are not sharp. The first elongate segment 20A is opposite the handle 14. The first elongate segment 20A generally defines the width of the bag holder 10 (e.g., maximum width of the bag opening 16). Accordingly, the bag opening 16 is generally largest opposite the handle 14 to more easily allow lawn debris to move into the bag 1. In addition, the linear first elongate segment 20A allows a large portion of the bag opening 16 to be positioned right next to the ground to make it easier to move the lawn debris into the bag 1. The second elongate segment 20B extends from a first end of the first elongate segment 20A at an acute angle A to the first elongate segment. The third elongate segment 20C extends from an opposite second end of the first elongate segment 20A at an acute angle B to the first elongate segment. Accordingly, the second and third elongate segments 20B, 20C extend generally inward, toward one another. The fourth elongate segment 20D extends from the second elongate segment 20B to the handle 14. The fifth elongate segment 20E extends from the third elongate segment 20C to the handle 14. Other configurations are within the scope of the present disclosure such as more or fewer segments, curved segments, etc.

Figure 1A:
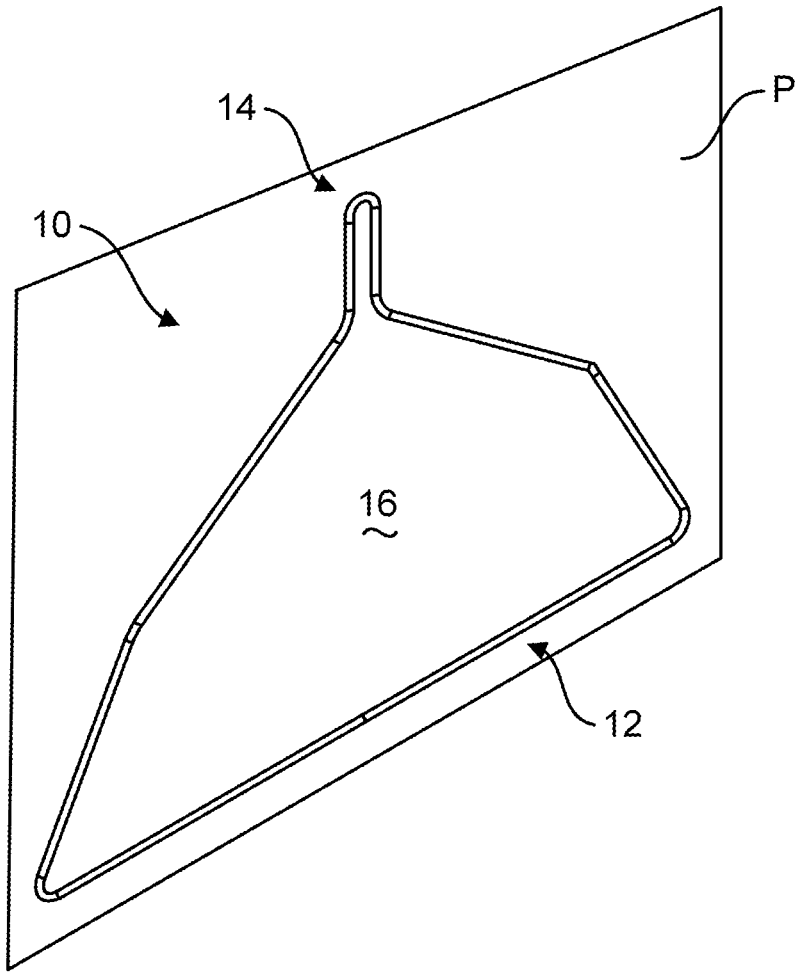
FIG. 1A is a perspective similar to FIG. 1, showing the bag holder in an imaginary plane.

The handle 14 is configured to be grasped by the user. The handle 14 is also sized and shaped to permit the open end portion 3 of the bag 1 to be folded over the handle when the open end portion of the bag is also folded over the bag support frame 12. This allows the open end portion 3 of the bag 1 to be completely folded over around the entire circumference of the bag, which forms a stronger connection than if only a portion of the open end portion was folded over. Moreover, this also positions a portion of the bag 1 at the handle 14, thereby allowing the user to grab both the handle and the bag with one hand. This helps secure the bag 1 to the bag holder 10, eliminating the need to secure the bag in the other ways, such as with some sort of bag retainer, such as a clip, a hook, an elastic strap, a ring, or any other manner of securement. Thus, the bag holder 10 (specifically, the bag support frame 12 and the handle 14) is free of a bag retainer configured to secure the bag 1 to the bag support frame. This makes it easier and quicker to attach the bag 1 to and remove the bag from the bag holder 10. Preferably, the handle 14 is relatively short to allow the open end portion 3 of the bag 1 to fold over it and the bag support frame 12. For example, in one embodiment, the length of the handle 14 is only as long as needed to be grasped by one hand of a user, such as within the inclusive range of about 3-5 inches. The handle 14 is free of any sharp corners, protrusions, and other elements which could potentially rip the bag 1 when the bag is mounted on the handle. The handle 14 extends outward from the bag support frame 12. In the illustrated embodiment, the bag opening 16 lies in a bag opening plane P (FIG. 1A). The handle 14 lies in the bag opening plane P. Likewise, the bag support frame 12 lies in the bag opening plane P. In other embodiments, the handle 14 may be disposed at an angle to the bag opening plane P.

In the illustrated embodiment, the handle 14 comprises a plurality of segments 22A-C (broadly, one or more segments). The first handle segment 22A extends from the fourth elongate segment 20D of the bag support frame 12. The second handle segment 22B extends from the fifth elongate segment 20E of the bag support frame. The first and second handle segments 22A, 22B are linear and elongate. The third handle segment 22C extends between and interconnects the first and second handle segments 22A, 22B. The third handle segment 22C is curved and elongate. Other configurations of the handle 14 are within the scope of the present disclosure.

In the illustrated embodiment, the bag holder 10 comprises a unitary body 11 that forms the bag support frame 12 and the handle 14. Preferably, the unitary body 11 is an integrally formed one-piece component. For example, the illustrated unitary body 11 comprises a one-piece wire formative—i.e., a single piece of wire bent into the shape shown to define the bag support frame 12 and the handle 14.

In other embodiments, the bag holder 10 may be comprised of multiple pieces, such as multiple wire formatives, joined together in a suitable manner, such as by welding. In one embodiment, the body 11 is formed from a ½ inch diameter wire, although other sizes of wire are within the scope of the present disclosure. The bag holder may be made of any suitable material such as metal (e.g., steel, aluminum, etc.) or plastic.

The bag holder 10 has a bag perimeter 24. The bag perimeter 24 is the path the circumference of the open end portion 3 of the bag 1 extends on and along (e.g., is where the bag is disposed) when the open end portion 3 is folded over the bag holder 10. The bag perimeter 24 is the shortest path around the bag holder 14. In the illustrated embodiment, the bag perimeter extends along the outside of the first, second and third elongate segments 20A-C and the third handle segment 22C (broadly, the tip of the handle 14), and extends directly between the third handle segment 22C and the end of the third elongate segment 20C (indicated by a dashed line) and directly between the third handle segment and the end of the second elongate segment 20B (indicated by another dashed line) as these are the shortest paths between those respective points. It is understood the bag perimeter 24 may have other configurations depending upon the construction of the bag holder 10 (e.g., bag support frame and/or handle). The bag holder 10 (specifically, the bag perimeter 24) is configured for a specific size of a bag 1. In one embodiment, the length of the bag perimeter 24 is within the inclusive range of about 80% of the circumference of the bag 1 to about 120% of the circumference of the bag, or more preferably within the inclusive range of about 90% of the circumference of the bag to about 110% of the circumference of the bag. Preferably, the open end portion 3 of the bag 1 is taut when folded around the bag holder 10. In one embodiment, the length of the bag perimeter 24 is equal to or greater than the circumference of the bag 1. For example, the length of the bag perimeter 24 may be within the inclusive range of about equal to the circumference of the bag 1 to about 110% of the circumference of the bag, or more preferably within the inclusive range of about equal to the circumference of the bag to about 105% of the circumference of the bag. This results in the open end portion 3 of the bag 1 having to be slightly stretched to be folded around the bag holder 10 (see FIG. 3), which results in the bag 1 being taut against the bag holder 10, thereby providing a more secure connection between the bag and the bag holder. Plastic bags 1 are slightly elastic and this stretching causes the open end portion 3 of the bag to encircle and compress against the bag holder 10 (see FIG. 2).

Bags 1 come in set sizes (e.g., set circumferences), such as 13 gallons, 18 gallons, 20 gallons, 33 gallons, 42 gallons, 45 gallons, 56 gallons, and 60 gallons (bag sizes are normally defined by their volume). It is understood the bag holder 10 of the present disclosure can be configured to be configured for any desired size of bag 1, such as by modifying the bag perimeter 24 to correspond to the desired bag size. While the bag holder 10 is preferably designed for a specific size of a bag 1 (e.g., a bag that will itself be taut when folded over the bag holder), it is understood the bag holder may be used with bags of a larger size than the size of bag the bag holder is designed for. In this case, the open end portion 3 of the bag 1 will not be taut after being folded around the bag holder. Instead, after the user folds the open end portion 3 of the bag 1 over the bag holder 10, the user bunches up the extra material at the handle 14 to pull the rest of the upper end portion taut against the bag support frame 12. To maintain the tautness and keep the bag 1 secured to the bag holder 10, the user grasps the extra material and the handle 14 at the same time.

Figure 4:
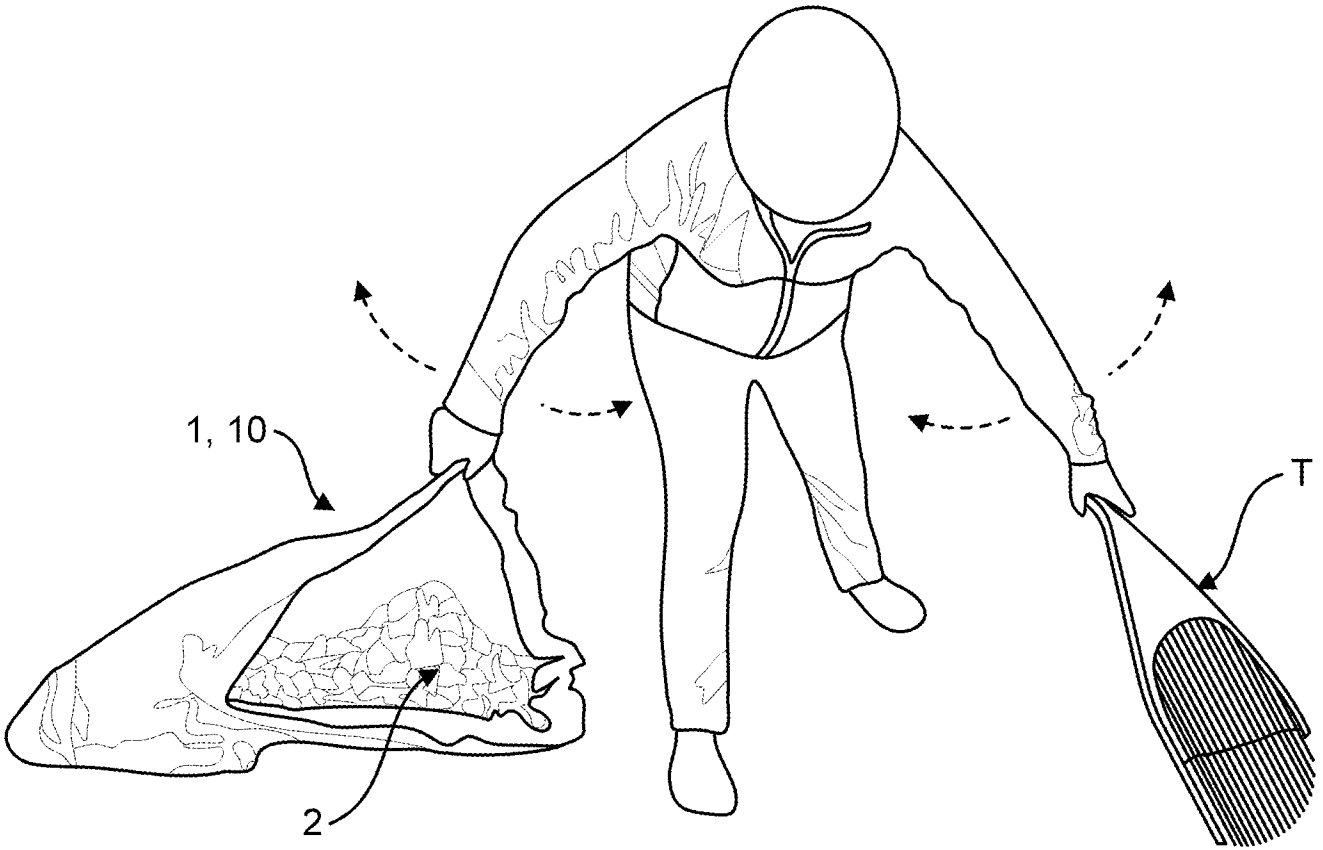
FIG. 4 is an illustration of the bag and bag holder being used to collect lawn debris.

With reference to FIGS. 3 and 4, to collect lawn debris using the bag holder 10, the user first attaches the bag 1 to the bag holder 10. The user inserts the open end portion 3 of the bag 1 through the bag opening 16 and then wraps or folds the open end portion over the bag holder 10. The user may first fold the open end portion 3 over the bag support frame 12 and then fold the open end portion of the bag over the handle 14, as shown in FIG. 3. After, the user can grasp the handle 14 and the bag 1 (e.g., a portion thereof) simultaneously with one hand, as shown in FIG. 2. As shown in FIG. 4, the user can then move the bag 1 and the bag holder 10 with the one hand to collect the lawn debris. The bag holder 10 keeps the mouth 2 of the bag 1 open while the bag is being moved. The user may use a tool T, such as a garden tool (e.g., leaf rake, broom, or the like) to direct the lawn debris toward the mouth 2 of the bag 1. Because the user needs only one hand to hold the bag 1 and bag holder 10, the user other hand can hold the tool T. Together the user uses the tool T and the bag holder 10 to collect the lawn debris. In one manner of operation, the user moves the bag 1/bag holder 10 and the tool T toward each other at generally the same time to push or scoop the lawn debris into the mouth 2 of the bag. In another manner of operation, the user keeps the bag 1/bag holder 10 generally still (while holding the unit by the handle) and uses the other hand (e.g., tool T) to move the lawn debris into the mouth 2 of the bag. In another manner of operation, the user keeps the tool T generally still and moves the bag 1/bag holder 10 toward the tool to scoop the lawn debris into the mouth 2 of the bag. In some cases, the user may lift the bag 1/bag holder 10 after moving lawn debris into the mouth 2 of the bag so that the lawn debris moves toward the bottom of the bag. Other ways of using the bag holder 10 are within the scope of the present disclosure. After the bag 1 is full (or all the lawn debris is collected), the user disconnects the bag from the bag holder 10 by reversing the steps taken to mount the bag to the bag holder. The user unfolds the open end portion 3 of the bag 1 around the bag holder 10 (e.g., the bag support frame 12 and the handle 14) and then removes the open end portion from the bag opening 16. The bag 1 can now be discarded and a new bag attached to the bag holder 10, as described above.

Figure 5:
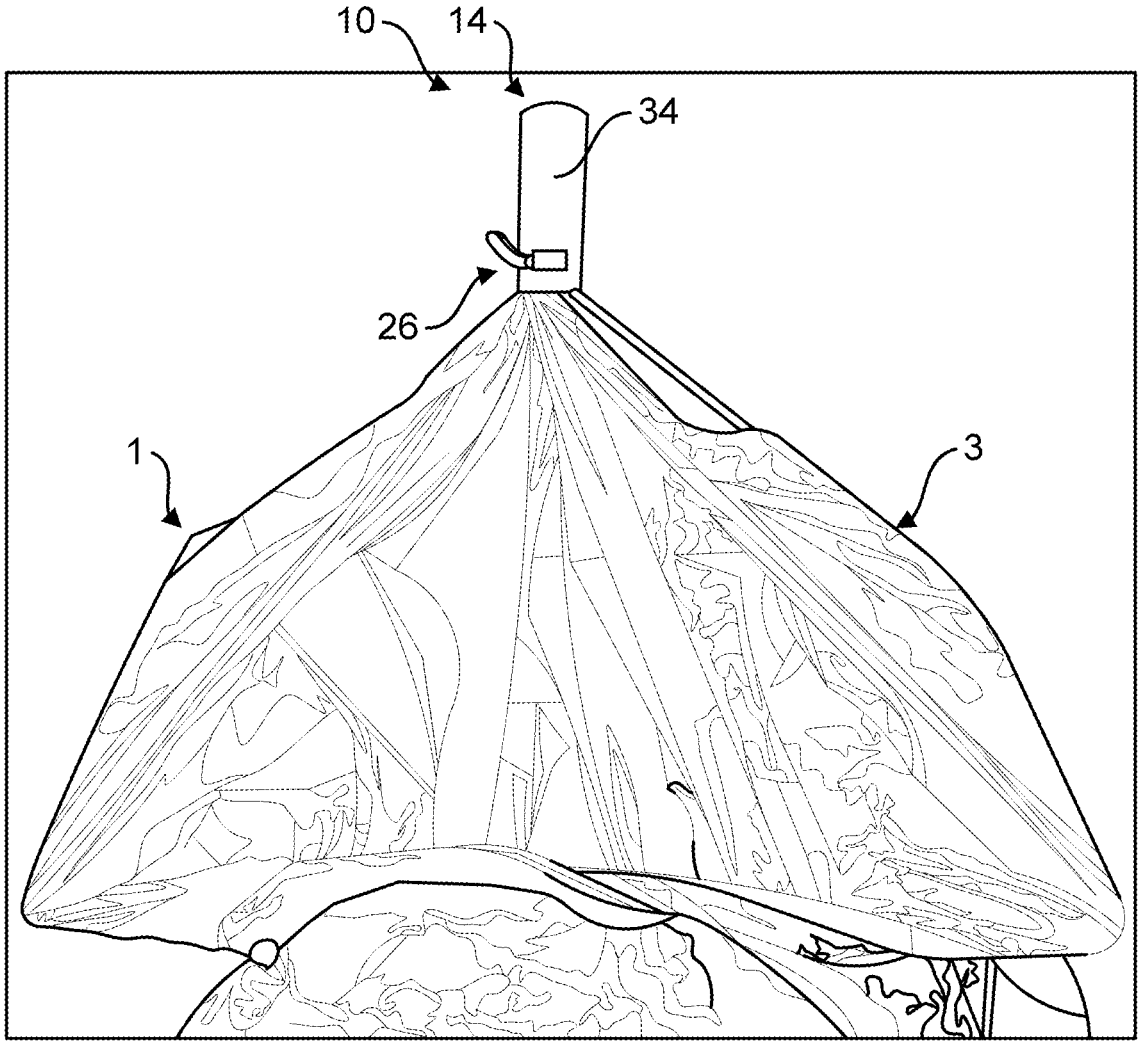
FIG. 5 is an illustration of the bag secured to a bag holder with a retainer.
Figure 6:
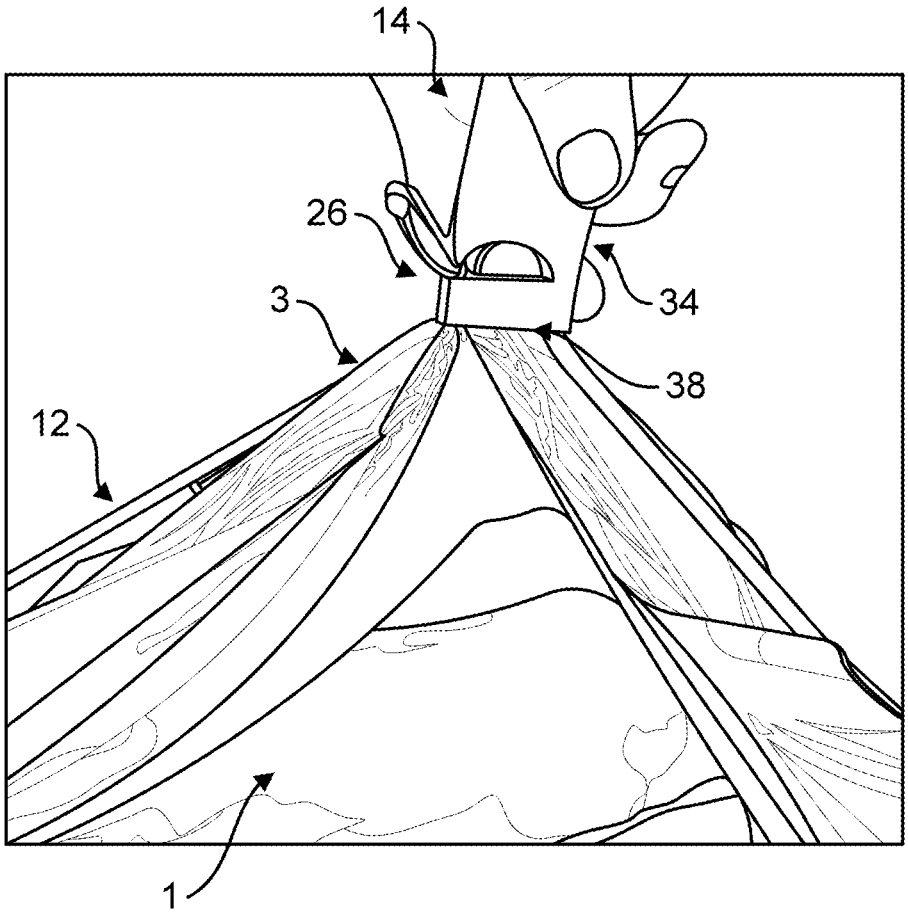
FIG. 6 is an enlarged view of a bag secured to the retainer of FIG. 5.
Figure 7:
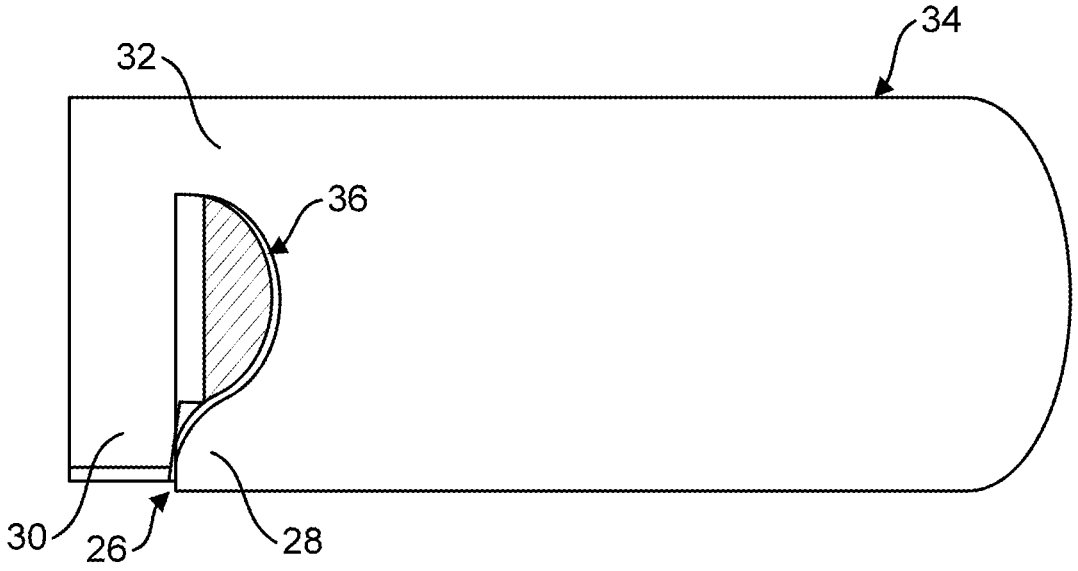
FIG. 7 is an illustration of the retainer of FIG. 5.

Referring to FIGS. 5-7, in one embodiment, the handle 14 of the bag holder 10 includes a retainer 26 (broadly, the retainer is attached to or supported by the handle). The retainer 26 is configured to secure the bag 1 to the bag support frame 12 (broadly, the bag holder 10). The retainer 26 allows the bag holder 10 to be used with bags 1 of a smaller size than the size of bag the bag holder is designed for. As shown in FIGS. 5 and 6, the smaller size of bag 1 cannot be folded around the entire bag holder 10. In this case, the open end portion 3 of the bag is folded around the bag support frame 12 with a portion of the open end portion of the bag being engaged by the retainer 26 to secure the open end portion to the bag support frame.

In the illustrated embodiment, the retainer 26 comprises a clip or clamp configured to clip to (broadly, engage) the bag 1, although other types of retainers such as hooks, fasteners, rope, clastic cords, straps (with buckles or hook and loop fasteners), and the like are within the scope of the present disclosure. The clip comprises first and second clipping portions 28, 30 arranged to clip the bag 1 therebetween. The first and second clipping portions 28, 30 are resiliently biased toward (specifically, into engagement with) one another. At least one of the first and second clipping portions 28, 30 is movable relative to the other to permit the portion of the bag 1 to be placed therebetween. In the illustrated embodiment, the second clipping portion 30 is resiliently biased toward the first clipping portion 28 and is movable relative to the first clipping portion via a living hinge 32, although other ways of biasing the first and second clipping portions toward one another are within the scope of the present disclosure, such as via a spring.

In the illustrated embodiment, the handle 14 includes a sleeve 34. The sleeve 34 is releasably coupled to a handle body of the handle 14. In this embodiment, the handle body includes the plurality of handle segments 22. The sleeve 34 can slide onto and off of the handle body. The sleeve 34 has an interior sized and shaped to receive the handle body. The sleeve 34 has an open end forming an opening at one end of the interior to permit the handle body to be inserted and removed from the interior. The opposite end of the sleeve 34 is closed. In this embodiment, the retainer 26 is formed by the sleeve 34 (broadly, the retainer is attached to or mounted on the sleeve). The sleeve 34 has a cutout 36 which defines the first and second clipping portions 28, 30 and the living hinge 34 in the sleeve. When mounted on the handle body, the sleeve 34 and handle body form an opening 38 sized and shaped to receive the portion of the bag 1 (FIG. 6). The opening 38 is arranged to permit the portion of the bag 1 inserted therethrough to extend to the retainer 26.

To attach the smaller size bag 1 to the bag holder 10, the user folds the lower end portion 3 of the bag 1 around the bag support frame 12. This stretches the lower portion of the mouth of the bag around the wide segment bottom 20A of the bag support frame 12, which establishes two points of connection between the back and the lower corners of the bag support frame (e.g., by the mouth of the bag being resiliently stretched over the two lower corners) and also establishes a wide flat edge along the lower end portion of the mouth of the bag for ground contact. After folding the mouth of the bag over the bag support frame 12, the user then bunches up the upper end portion of the bag adjacent the handle 14 and inserts the bunched material through the opening 38. The user then draws the bunched material through the space between the clipping portions 28, 30 to establish a third point of connection and tighten the mouth of the bag over the frame 12. The first and second clipping portions 28, 30 squeeze the bag 1 therebetween, thereby securing the bag to the bag holder 10. Alternatively, the bunched bag material is simply compressed between the handle 14 and the sleeve 34, which secures the bag to the handle. To release the bag 1, the user pulls the portion of the bag 1 out from the retainer 26 and through the opening 38. The user may deflect the second clipping portion 28 to release the portion of the bag 1 from the retainer 26.

Figure 8:
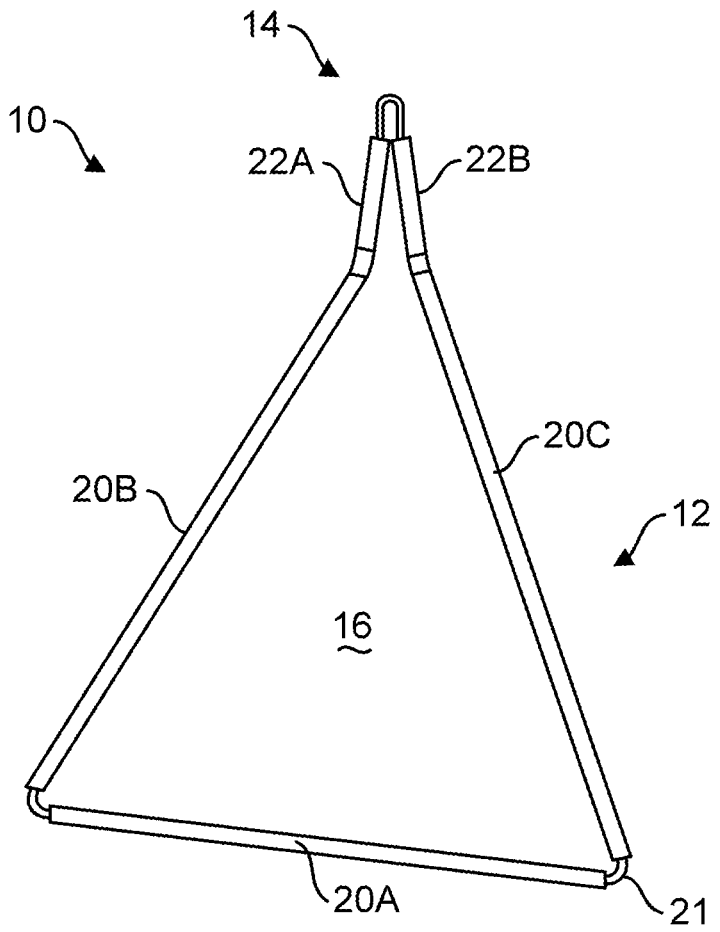
FIG. 8 is a perspective of another embodiment of a bag holder.

Referring to FIG. 8, another embodiment of a bag holder according to the present disclosure is generally indicated at reference numeral 10'. The bag holder 10' of FIG. 8 is generally analogous to the bag holder 10 of FIGS. 1-7 and, thus, for case of description, where similar, analogous, or identical parts are used, identical reference numerals are employed. Accordingly, unless clearly stated or indicated otherwise, the descriptions regarding the bag holder 10 of FIGS. 1-7 also apply to the bag holder 10' of FIG. 8.

In this embodiment, the bag holder 10' (specifically, the bag support frame 12 and/or handle 14) is configurable or arrangeable in a deployed configuration and a collapsed configuration. In the deployed configuration, the bag holder 10' is arranged to receive a bag 1 to collect the lawn debris-see FIG. 1. In the deployed configuration, the bag support frame 12 generally has the configuration shown and described above. For example, the bag support frame 12 forms the bag opening 16 sized and shaped to receive the open end portion 3 of the bag 1. In the collapsed configuration, the bag holder 10' is collapsed such that the bag holder takes up less space than in the deployed configuration and can be more easily stored.

In the illustrated embodiment, the elongate segments 20, 22 forming the bag support frame 12 and the handle 14 are tubular segments (broadly, the bag support frame and handle each include one or more tubular segments). The tubular segments 20, 22 have hollow interiors. The bag holder 10' includes an elastic cord or band 21 extending through the tubular segments 20, 22 and loosely connecting the tubular segments together. The tubular segments 20, 22 are releasably connected together. When all the tubular segments 20, 22 are connected together, the bag holder 10' is in the deployed configuration. When the tubular segments are disconnected, the bag holder 10' is in the collapsed configuration. In one embodiment, the corners of the bag support frame 12 and handle 14 (e.g., segment 22C) are formed by connectors, such as slightly larger tubular segments (curved to form the corners) that have open ends sized and shaped to receive the ends of the tubular segments 20, 22 of the bag support frame 12 and the handle 14. To connect the tubular segments 20, 22 together, the ends of the tubular segments are inserted into the open ends of the connectors. To disconnect the tubular segments 20, 22, the ends of the tubular segments are removed from the open ends of the connectors. The elastic cord 21 maintains the connection between the tubular segments 20, 22 and the connectors but also permits the disconnection of the tubular segments from the connectors when the user applies a sufficient amount of force to overcome the biasing force of the elastic cord. The elastic cord 21 keeps the tubular segments 20, 22 in the correct order relative to one another, which makes it easier to reassemble the bag holder 10' in the deployed configuration. When the tubular segments 20, 22 are disconnected, the elastic cord 21 also allows the tubular segments to freely fold next to one another to collapse the bag holder 10'. Other ways of releasably connecting the elongate segments 20, 22 of the bag support frame 12 and/or handle 14 are within the scope of the present disclosure.

Figure 9:
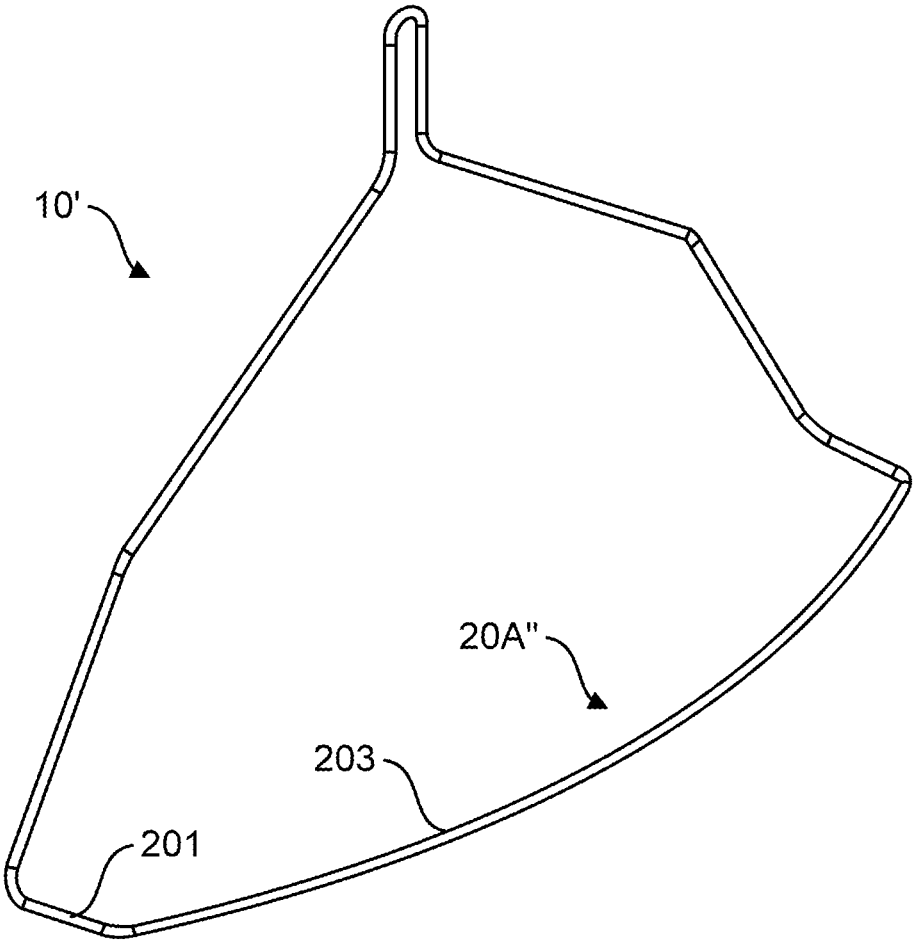
FIG. 9 is a perspective of another embodiment of a bag holder.

Referring to FIG. 9, another embodiment of a bag holder 10" is similar to the bag holder 10, except the bottom segment 20A" of the frame includes arms 201 that extend rearward and a cross member 203 between the rear ends of the arms. During use, the mouth of the bag is inserted forward through the interior of the frame, and the lower portion of the mouth of the bag is folded under the bottom segment 20A".

Figure 10:
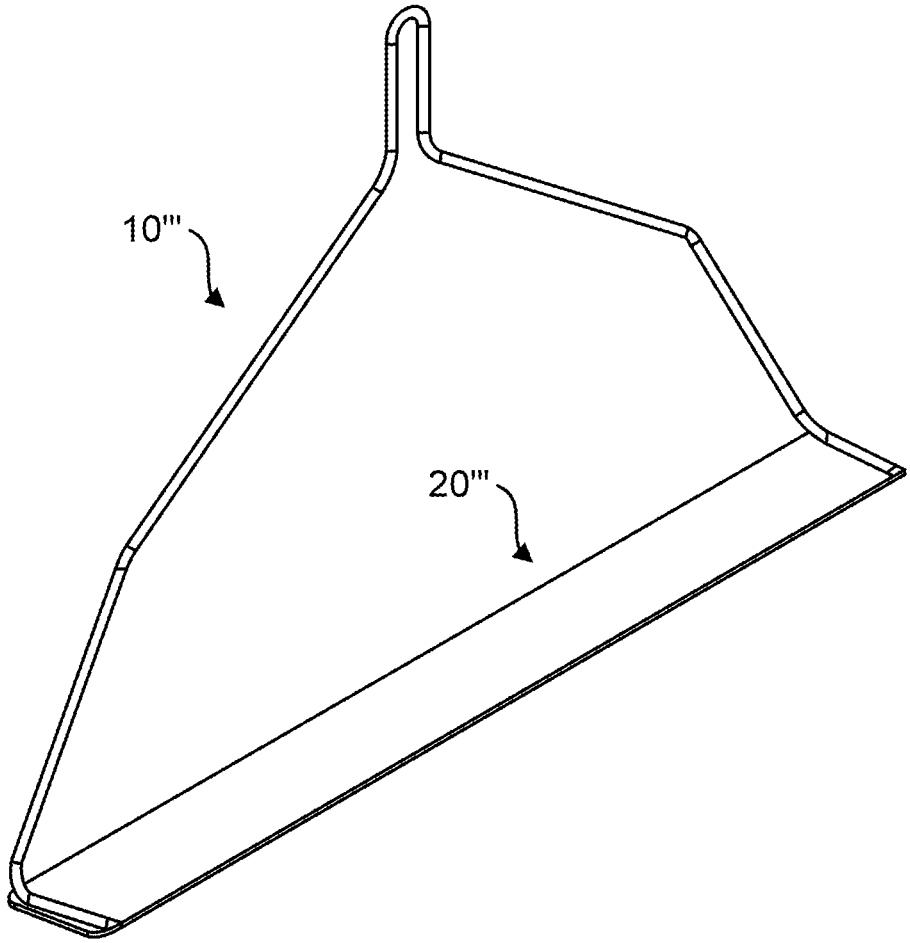
FIG. 10 is a perspective of another embodiment of a bag holder.

Referring to FIG. 10, in yet another embodiment, a bag holder 10" is similar to the bag holder 10", except the bottom segment 20A" of the frame is formed from a flat strip of material instead of wire.

Figure 11:
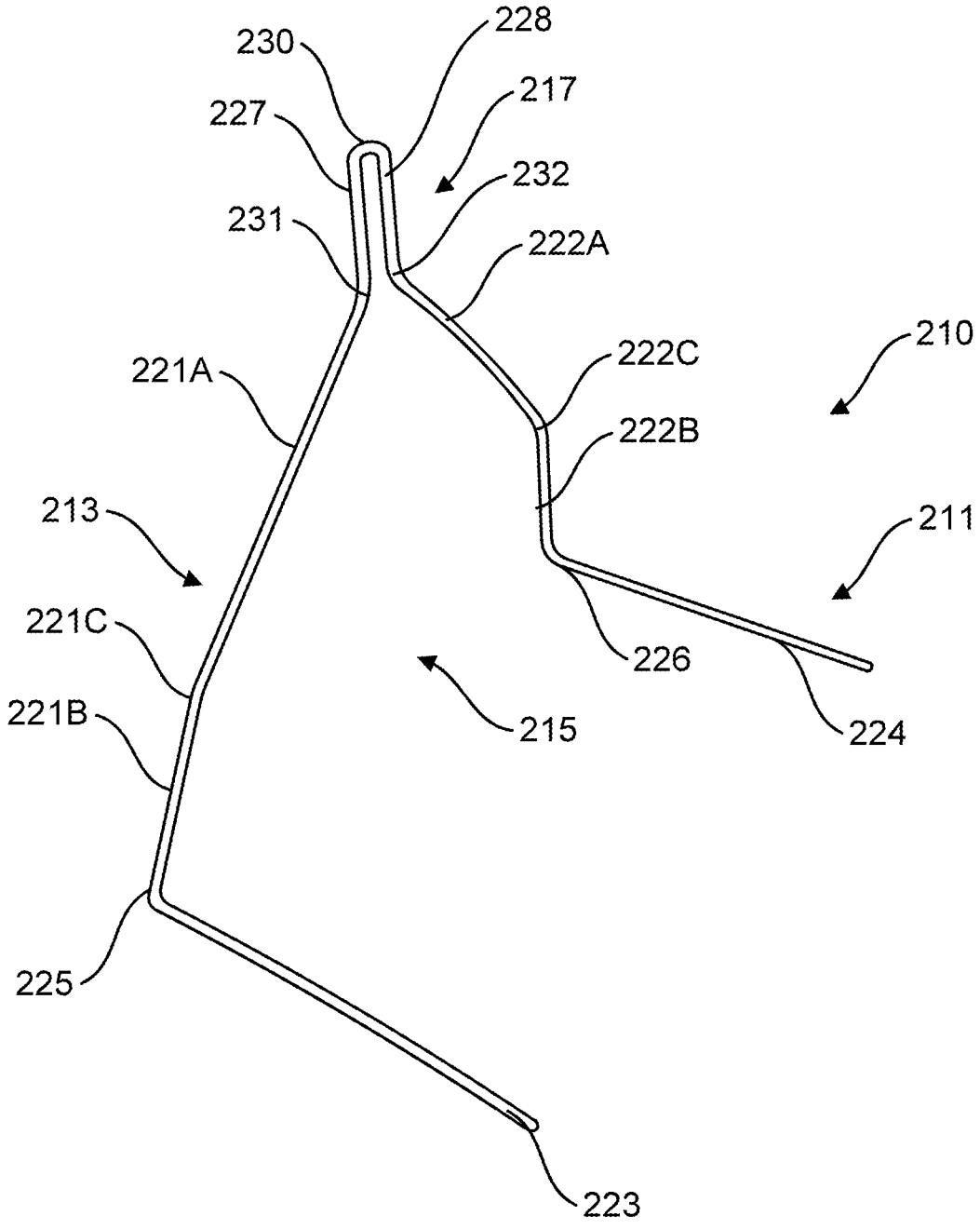
FIG. 11 is a perspective of another embodiment of a bag holder.
Figure 12:
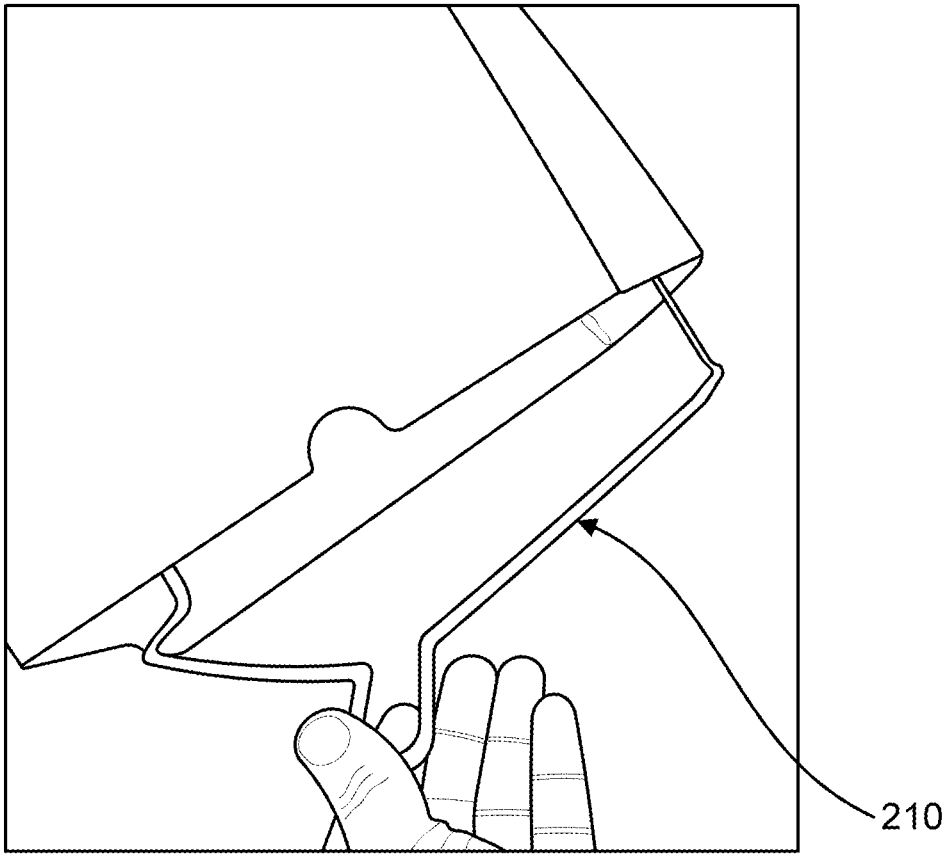
FIG. 12 is an illustration of a bag partially loaded onto the bag holder shown in FIG. 11.
Figure 13:
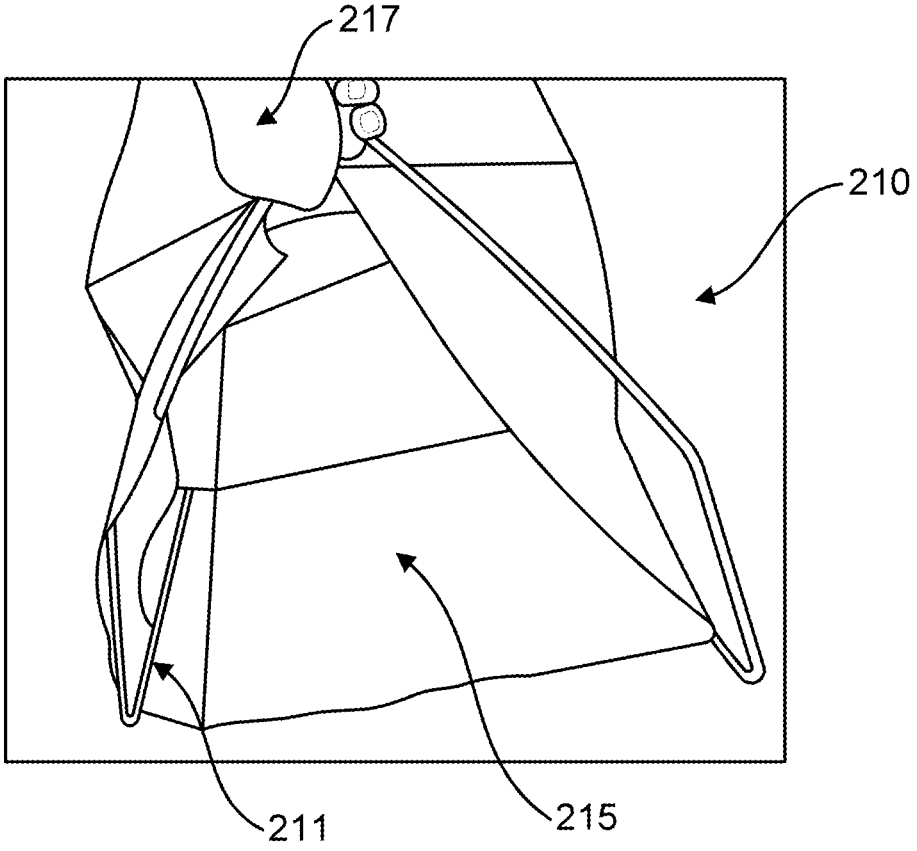
FIG. 13 is an illustration of the bag and bag holder shown in FIGS. 11 and 12 being used.

Referring to FIGS. 11-13, another embodiment of a bag holder in accordance with the present disclosure is generally indicated at reference number 210. The bag holder 210 has some similarities to the bag holders described above. However, the illustrated bag holder 210 is configured for use with paper lawn waste bags. The bag holder 210 has three main parts: a footing 211 for holding a lower portion of the mouth of the bag in an outstretched configuration, a frame 213 standing up from the footing to define a framed opening 215 above the outstretched lower portion of the mouth of the bag, and an upper handle 217 that allows the user to simultaneously grip both the bag holder 210 and upper portion of the bag mouth with only one hand.

In use, the footing 211 is inserted into the mouth of the bag whereby a lower portion of the mouth stretches across the footing from a left footing portion to a right footing portion. This establishes a wide flat edge along the lower end portion of the mouth of the bag for ground contact. When the wide flat edge is pressed against the ground, it is relatively easy for the user to rake debris over the wide flat edge and through the framed opening 215 into the bag.

The frame 213 and the handle 217 are sized and arranged so that when the footing 211 is inserted into the mouth of the bag to establish the wide flat lower edge, one hand gripping the handle can simultaneously grasp an upper portion of the mouth of the leaf waste bag to hold the mouth open adjacent (e.g., immediately behind) the framed opening 215 such that leaf waste can be raked through the framed opening into the bag.

Thus, the bag holder 210 is configured to establish a first point of connection with the bag at the left portion of the footing 211, a second point of connection with the bag at the right portion of the footing, and a third point of connection with the bag where the one hand gripping the handle 217 simultaneously grasps the upper portion of the bag mouth. The first, second, and third points of connection together hold the mouth outstretched to define a generally triangular opening that is widest along the flat bottom edge of the mouth.

In the illustrated embodiment, the bag holder is an integrally formed, one-piece wire formative. The wire formative comprises a generally upright left leg segment 221 and a generally upright right leg segment 222 defining left and right sides of the frame 213. Each leg segment 221, 222 has respective top and bottom ends. In the illustrated embodiment, each of the left and right leg segments comprises an upper section 221A, 222A and a lower section 221B, 222B connected at a respective central leg bend 221C, 222C. The central 221C, 222C leg bends define obtuse angles (e.g., from 110 to 160 degrees).

The wire formative further comprises a left foot segment 223 extending backward from a bottom end of the left leg segment 221 and a right foot segment 224 extending backward from the bottom end of the right leg segment 222. In comparison to the bag holders of the previous embodiments, the foot segments 223, 224 of the present bag holder 210 are relatively long (e.g., between 4 inches and 10 inches). The left and right foot segments 223, 224 are connected to the left and right leg segments 221, 222 by lower left and right corner bends 225, 226, respectively. In the illustrated embodiment, each of the left and right corner bends 225, 226 defines an angle of from 70 degrees to 110 degrees such that the leg segments 221, 222 extend generally upright when the foot segments 223, 224 are pressed flat onto horizontal ground. The foot segments 223, 224 are generally parallel and are spaced apart by a distance corresponding to the desired width of the wide flat opening of the bag mouth (e.g., a distance of from 14 inches to 28 inches).

The wire formative further comprises a left handle segment 227 extending upward from the top end of the left leg segment 221, a right handle segment 228 extending upward from the top end of the right leg segment 222, and a bridge 230 connecting the left handle segment and the right handle segment opposite the left and right leg segments. The illustrated wire formative comprises left and right handle bends 231, 232 connecting the left and right handle segments 227, 228 to the left and right leg segments 221, 222, respectively. The handle bends 231, 232 can define obtuse angles in an inclusive range of from 110 to 160 degrees. In the illustrated embodiment, the left and right handle segments 227, 228 are generally parallel.

Figure 14:
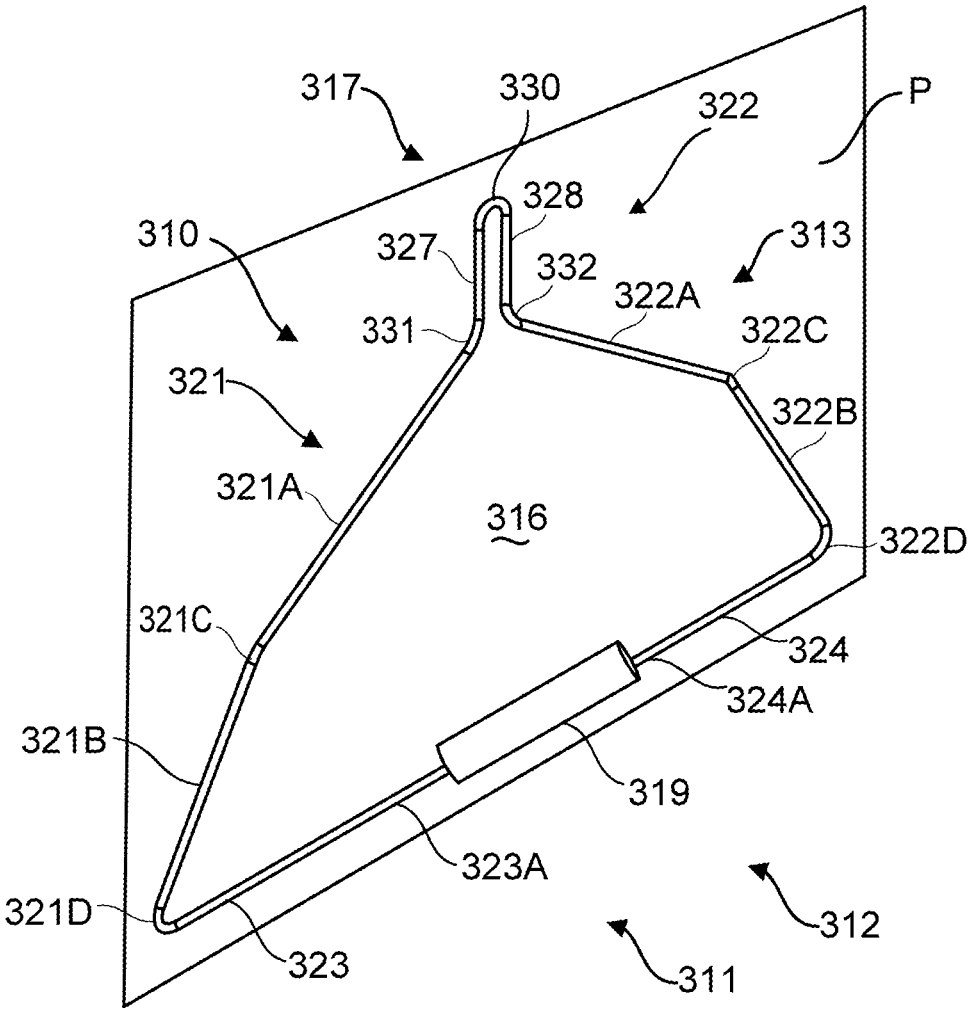
FIG. 14 is a perspective of another embodiment of a bag holder.
Figure 15:
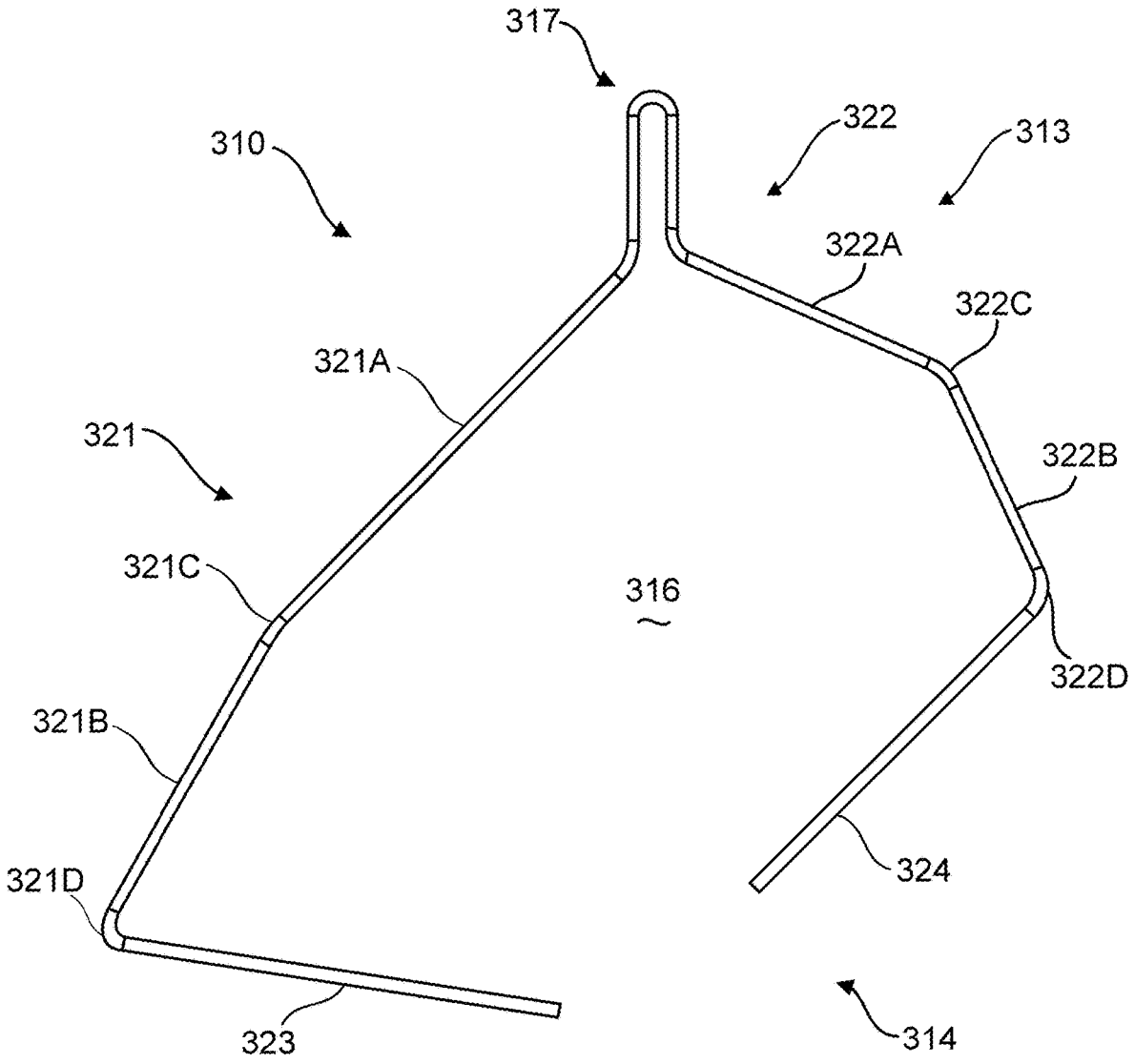
FIG. 15 is another perspective of the bag holder shown in FIG. 14.

Referring to FIGS. 14-15, another embodiment of a bag holder in accordance with the present disclosure is generally indicated at reference number 310. The bag holder 310 has some similarities to the bag holders described above and shown in FIGS. 1-13. However, the bag holder 310 is configured in a hybrid bag holder configuration wherein the bag holder 310 is configured for use with plastic and paper lawn waste bags. Suitably, the bag holder 310, as will be explained in greater detail below, is bendable between a closed frame configuration 312 (FIG. 14), wherein the bag holder has similar functionality to the bag holder 10 shown in FIGS. 1-10, and an open frame configuration 314 (FIG. 15), wherein the bag holder has similar functionality to the bag holder 210 shown in FIGS. 11-13.

The bag holder 310 has three main parts: a footing 311 for holding a lower portion of the mouth of the bag in an outstretched configuration, a frame 313 standing up from the footing to define a framed opening 316 above the outstretched lower portion of the mouth of the bag, and a handle 317 that allows the user to simultaneously grip both the bag holder 310 and upper portion of the bag mouth with only one hand. The frame 313 comprises an upper end portion and a lower end portion, and defines the framed opening 316. The handle 317 is at the upper end portion of the frame 313, and is configured to be gripped with one hand for one-handed manipulation of the bag holder and bag. The footing 311 is adjacent the lower end portion of the frame 313 and comprises a left foot and a right foot. The left and right feet are configured to be bent between the closed frame configuration 312 wherein the framed opening 316 is generally closed, and the open frame configuration 314 wherein the bottom of the framed opening 316 is open (similar to the (paper) bag holder 210). The footing 311 in the closed frame configuration 312, is configured to permit an open end portion of the bag (e.g., the plastic bag) to be folded over the frame 313 to mount the bag on the bag holder 310 and to hold open a mouth of the bag. The footing 311 in the open frame configuration is insertable into the mouth of the bag (e.g., the paper bag) whereby a lower portion of the mouth is stretched across the footing from the left foot to the right foot establishing a wide flat edge along the lower portion of the mouth of the bag for ground contact.

In an embodiment, the bag holder 310 further comprises a removable sheath 319 configured for securing the left and right feet in the closed frame configuration 312. In FIG. 14, the removable sheath 319 comprises a tube configured for receiving ends of the left and right feet to define a continuous frame segment with the frame opening 316 being closed. It is also envisioned that the bag holder 310 may comprise a removable flat bottom segment configured to attach to the bag holder proximate the continuous frame segment to establish a flat wide edge for the bag holder in the closed frame configuration. In one embodiment, the removable flat bottom segment is similar to the bottom segment 20A" shown in FIG. 10.

In the illustrated embodiment, the bag holder 310 (excluding the removable sheath 319) is an integrally formed, one-piece wire formative. The wire formative comprises a generally upright left leg segment 321 and a generally upright right leg segment 322 defining left and right sides of the frame 313. Each leg segment 321, 322 has respective top and bottom ends. In the illustrated embodiment, each of the left and right leg segments 321, 322 comprises an upper section 321A, 322A and a lower section 321B, 322B connected at a respective central leg bend 321C, 322C. The central 321C, 322C leg bends define obtuse angles (e.g., from 110 to 160 degrees).

The wire formative defines the footing 311 to comprise a left foot segment 323 connected to the left leg segment 321 at a lower left leg bend 321D. Similarly, the footing comprises a right foot segment 324 connected to the right leg segment 322 at a lower right leg bend 322D. The foot segments 323, 324 are configured to bend from the closed frame configuration 312 shown in FIG. 14 to the open frame configuration 314 shown in FIG. 15. In the closed frame configuration 312, the foot segments 323, 324 extend towards one another, and optionally, respective ends 323A, 324A are connected to the sheath 319 to form a continuous segment 325 such that the framed opening 316 is closed. It is to be understood that the closed frame configuration 312 does not require complete closure of the framed opening 316, however. For example, the foot segments 323, 324 could be unsheathed and arranged generally end-to-end with a small gap between them in the closed frame configuration 312 without departing from the scope of the disclosure. In the open frame configuration 314, the foot segments 323, 324 extend away from the framed opening 316. For example, the foot segments 323, 324 can be generally parallel. In the open frame configuration, the foot segments 323, 324 can be bent so that they are spaced apart by a distance corresponding to the desired width of a wide flat opening of the bag mouth (e.g., a distance of from 14 inches to 28 inches).

The wire formative further defines the handle 317 to comprise a left handle segment 327 extending upward from the top end of the left leg segment 321, a right handle segment 328 extending upward from the top end of the right leg segment 322, and a bridge 330 connecting the left handle segment and the right handle segment opposite the left and right leg segments. The illustrated wire formative comprises left and right handle bends 331, 332 connecting the left and right handle segments 327, 328 to the left and right leg segments 321, 322, respectively. The handle bends 331, 332 can define obtuse angles in an inclusive range of from 110 to 160 degrees. In the illustrated embodiment, the left and right handle segments 327, 328 are generally parallel.

Having described the disclosure in detail, it will be apparent that modifications and variations are possible without departing from the scope of the disclosure defined in the appended claims. For example, where specific dimensions are given, it is understood these dimensions are illustrative and other dimensions are within the scope of the present disclosure.

When introducing elements of the present disclosure or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the disclosure are achieved and other advantageous results attained. As various changes could be made in the above products and methods without departing from the scope of the disclosure, it is intended that all matter contained in the above description shall be interpreted as illustrative and not in a limiting sense.

The invention claimed is:

1. A bag holder for holding open a bag while sweeping or raking debris from the ground into the bag, the bag holder comprising:

a frame comprising an upper end portion and a lower end portion, the frame defining a framed opening;

a handle at the upper end portion of the frame, the handle configured to be gripped with one hand for one-handed manipulation of the bag holder and bag;

a footing adjacent the lower end portion of the frame, the footing comprising a left foot and a right foot, wherein the left and right feet are configured to be bent between a closed frame configuration wherein the left and right feet are positioned generally below the frame opening, and an open frame configuration wherein the left and right feet extend away from the frame opening, the footing in the closed frame configuration configured to permit an open end portion of the bag to be folded over the frame to mount the bag on the bag holder and to hold open a mouth of the bag, the footing in the open frame configuration being insertable into the mouth of the bag whereby a lower portion of the mouth is stretched across the footing from the left foot to the right foot establishing a wide flat edge along the lower portion of the mouth of the bag for ground contact; and wherein the handle, the frame, and the footing are an integrally formed one-piece component.

2. The bag holder of claim 1, further comprising a removable sheath, the removable sheath configured for receiving the left and right feet in the closed frame configuration to define a continuous frame segment.

3. The bag holder of claim 1, wherein the integrally formed one-piece component comprises a wire formative.

4. The bag holder of claim 3, wherein the wire formative comprises a generally upright left leg segment and a generally upright right leg segment defining left and right sides of the frame and having respective top and bottom ends, the left and right feet being connected to the left and right leg segments by lower left and right corner bends respectively.

5. The bag holder of claim 4, wherein the handle further comprises a left handle segment extending upward from the top end of the left leg segment, a right handle segment extending upward from the top end of the right leg segment, and a bridge connecting the left handle segment and the right handle segment opposite the left and right leg segments, and wherein the wire formative further comprises left and right handle bends connecting the left and right handle segments to the left and right leg segments respectively.

6. The bag holder of claim 5, wherein the left and right handle segments are generally parallel.

7. The bag holder of claim 5, wherein each of the left and right leg segments comprise upper and lower sections connected at respective central leg bends.

8. The bag holder of claim 1, wherein the frame and handle substantially bound a perimeter of the framed opening, and wherein the handle is sized and shaped to permit the open end portion of the bag to be folded over the handle when the open end portion of the bag is folded over the frame.

9. The bag holder of claim 1, further comprising a bag retainer configured to secure the bag to the frame.

10. The bag holder of claim 9, wherein the bag retainer comprises a clip configured to clip to the bag and wherein the handle includes an opening sized and shaped to receive a portion of the bag and arranged to permit said portion of the bag to extend to the clip.

11. The bag holder of claim 9, wherein the bag retainer comprising a sleeve releasably coupled to the handle.

12. The bag holder of claim 1, wherein the one hand gripping the handle can simultaneously grasp an upper portion of the mouth of the bag to hold the mouth open adjacent the framed opening such that debris can be raked through the framed opening into the bag, and wherein the bag holder is configured to establish a first point of connection with the bag at the left foot, a second point of connection with the bag at the right foot, and a third point of connection with the bag where the one hand grips the handle and grasps the upper portion of the mouth of the bag.

13. The bag holder of claim 12, wherein the first, second, and third points of connection are configured to hold the bag for defining a generally triangular opening defined by a wide flat edge of the mouth of the bag and first and second edges of the mouth of the bag extending respectively from the first and second points of connection to the third point of connection.

* * * * *